US005522968A

United States Patent [19]

Kuroyama et al.

[11] Patent Number: 5,522,968

[45] Date of Patent: Jun. 4, 1996

[54] INK JET RECORDING PAPER

[75] Inventors: Yoshihiro Kuroyama; Yumiko Satoh; Yoshifumi Iimori, all of Tokyo, Japan

[73] Assignee: Nippon Paper Industries Co., Ltd., Tokyo, Japan

[21] Appl. No.: 899,988

[22] Filed: Jun. 17, 1992

[30] Foreign Application Priority Data

Aug. 15, 1991 [JP] Japan ..... 3-229499

[51] Int. Cl.[6] ..... D21H 3/66; D21H 1/22

[52] U.S. Cl. ..... 162/181.1; 162/181.7; 162/181.8; 162/135; 428/537.5; 428/537.7

[58] Field of Search ..... 162/181.1, 135, 162/181.8, 181.6, 161, 181.2, 181.4, 183, 184; 428/195, 537.7, 211, 535.5

[56] References Cited

U.S. PATENT DOCUMENTS

| | | | |
|---|---|---|---|
| 2,399,982 | 5/1946 | Britt | 162/181.4 |
| 3,536,578 | 10/1970 | Brundige | 162/160 |
| 3,723,164 | 3/1973 | Marton | 162/160 |
| 3,884,625 | 5/1975 | Green | 162/168.1 |
| 4,110,155 | 8/1978 | Minagawa et al. | 162/135 |
| 4,263,073 | 4/1981 | Jaisle et al. | 162/135 |
| 4,327,174 | 4/1982 | von Meer | 162/135 |
| 4,335,184 | 6/1982 | Miyamoto et al. | 162/135 |
| 4,559,103 | 12/1985 | Nomura et al. | 162/160 |
| 4,832,793 | 5/1989 | Alexander | 162/181.8 |
| 4,994,147 | 2/1991 | Foley | 162/183 |
| 5,182,175 | 1/1993 | Sakaki et al. | 428/195 |
| 5,266,383 | 11/1993 | Sakaki et al. | 428/195 |

FOREIGN PATENT DOCUMENTS

| | | | |
|---|---|---|---|
| 0178033 | 4/1986 | European Pat. Off. | 162/180 |

OTHER PUBLICATIONS

Pulp and Paper, Chemistry and Chemical Technology, vol. III, Third Edition, New York, Wiley–Interscience Publication, 1981, pp. 1518–1519.

*Primary Examiner*—Brenda A. Lamb

*Attorney, Agent, or Firm*—Millen, White, Zelano, & Branigan

[57] ABSTRACT

Fine paper type ink jet recording paper which has a pH 6.0–8.0 in cold water extraction to provide printed letters of high quality, is produced by using a basal paper comprising wood cellulose and a filler which has a pH 4.0–8.0 as a 10 wt % dispersion and by applying an alkali metal salt at a coverage rate of 0.01–5.0 g/m$^2$ to at least one surface of said basal paper.

9 Claims, No Drawings

INK JET RECORDING PAPER

BACKGROUND OF THE INVENTION

This application claims the priority of Japanese Patent Application No. 3-229499 filed Aug. 15, 1991, which is incorporated herein by reference.

1. Field of the Invention

The present invention relates to ink jet recording paper and, more particularly, to fine paper type ink jet recording paper on which printed letters of high quality can be recorded.

2. Description of the Related Art

An ink jet recording method involves forcing ink to jet in the form of corpuscles using various mechanisms and making the ink corpuscles adhere to recording paper so as to record thereon patterns (including letters, characters and so on) in ink dots. Therefore, the method has advantages as that it can reduce generation of noise upon printing, can offer high quality full color recording and enables high-speed printing, compared with dot impact type recording methods in which typing dots are applied mechanically on recording paper.

On the other hand, ink used for ink jet recording has a defect that it is inferior in drying speed, because it is, in general, an aqueous ink containing direct dyes such as acid dyes.

Accordingly, ink jet recording paper must have the following characteristics:

(1) heighten the drying speed of ink dots adhering thereto, (2) ensure a high optical density of the printed patterns, and (3) causes little spread or running of the ink dots.

For the purpose of improving the foregoing characteristic (1), a measure to increase the ink absorbance of paper, or incorporation of silica having a great specific surface area into paper, has so then been taken. However, this measure has the defect that ink corpuscles applied to the recording paper into which silica is incorporated are absorbed thereinto with spreading, so that individual ink dots are enlarged in area and cause not only a drop in the optical density of a printed pattern but also blurring of the dots. Accordingly, it cannot meet the current needs of high image quality and high resolution.

In order to solve the above-described problem, recording papers have been prepared by coating various sizing agents, such as polyvinyl alcohol, polyvinyl pyrrolidone and the like, on the surface of the stock paper have been proposed, and have achieved good results.

On the other hand, neutral paper containing calcium carbonate as filler is prevailingly used as the stock for recording paper because of its superiorities in preservation and whiteness. However, such neutral paper also suffers from the disadvantages described below, because the pH thereof in cold water extraction is generally in the range of 9.0 to 10.0. That is, in a case where printing on said recording paper is carried out with aqueous ink comprising acid dyes or the like, the optical density of a printed pattern is low or the printed pattern lacks uniformity in quality, and also where full-color printing is carried out with a full-color ink jet printer each aqueous ink undergoes a change in color formability or the printed colors are discolored with a resultant failure in the faithful reproduction of the original colors.

SUMMARY OF THE INVENTION

As a result of our intensive studies, it has now been found that a quite satisfactory result can be obtained with ink jet recording paper whose pH in cold water extraction is 6.0–8.0 as a result of applying a prescribed amount of an alkali metal salt to at least one surface of stack paper containing a specific filler, thus achieving the present invention.

Therefore, an object of the present invention is to provide ink jet recording paper on which images of high optical density, satisfactory color reproducibility, high quality and high resolution can be printed and retained even after the printing operation.

The above-described object of the present invention is attained with an ink jet recording paper which has a pH of 6.0–8.0 in cold water extraction by using a basal paper comprising of wood cellulose and a filler of the kind which has pH of 4.0–8.0 as a 10 wt % dispersion and 0.01–5.0 g/m$^2$ of an alkali metal salt thereof; on at least one surface.

DETAILED DESCRIPTION OF THE INVENTION

The term "pH in cold water extraction" as used herein refers to the pH determined according to JIS P8133.

The wood cellulose present in the present invention has no particular restriction, so that it can be chosen properly from conventional ones.

It is required of a filler used in the present invention to have the pH in the range of 4.0–8.0, especially in the vicinity of pH 7, in a condition of 10 wt % dispersion.

The expression "condition of 10 wt % dispersion" as used above signifies the condition that a filler is dispersed in water in a concentration of 10 wt %.

When the dispersion has a pH value higher than 8.0, it causes the lowering of the optical density of printed letters and exerts undesirable influences upon color developability in full-color printing.

When the pH of the dispersion is lower than 4.0, on the other hand, a coverage of alkali metal salts required for adjustment to the pH range in cold water extraction does not fall within the prescribed range, so that deterioration of recording properties occurs.

As for the filler, kaolinite, illite, plastic pigments or mixtures of two or more thereof can be given as suitable examples. Also, other fillers can be used together, provided that the dispersion of the mixed filler can be adjusted to pH 4 to 8.

Among these fillers, kaolinite and illite are especially preferred in respect that they can ensure high qualities to printed letters and can afford facility for making paper.

In addition, even fillers the pH of which is higher than 8 or lower than 4 can be used, provided that their pH values in the dispersed condition can be adjusted to the range of 4.0 to 8.0 by a surface treatment or a coating treatment. An amount of fillers added to the basal paper is usually controlled to the range of 3 to 30 wt %.

Further, a sizing agent can be added to the basal paper of the present invention.

Suitable examples of a sizing agent which can be used herein include alkylketene dimers, alkenylsuccinic acid anhydrides and other neutral ones. However, acidic sizing agents used for making acid paper, such as rosin, aluminum sulfate and the like can be used together with neutral ones so far as the combined use causes no deterioration in preservation of paper.

Alkali metal salts used in the present invention don't have any particular restriction so far as they enable the ink jet recording paper to be adjusted to pH 6.0–8.0 in the cold water extraction.

Specific examples of alkali metal salts described above include hydroxides, such as sodium hydroxide, potassium hydroxide, etc.; silicates, such as sodium silicate, etc.; carbonates or hydrogen carbonates, such as sodium carbonate, sodium hydrogen carbonate, etc.; phosphates, hydrogenphosphates or dihydrogenphosphates, such as sodium phosphate, disodium hydrogenphosphate, sodium dihydrogenphosphate, etc.; borates, such as sodium borate, potassium borate, etc.; aluminates, such as sodium aluminate, potassium aluminate, etc.; alkali metal salts of carboxylic acids, such as sodium acetate, sodium phthalate, potassium hydrogen phthalate, etc.; and alkali metal salts of organic compounds containing acidic hydrogen(s), other than carboxylic acids, such as sodium phenolate, etc.

These alkali metal salts are applied to the surface of the basal paper in the fore of aqueous solution. A desirable concentration of such an aqueous solution ranges from 0.1 to 10.0 wt %. A preferred coverage of such alkali metal salts is in the range of 0.01 to 5.0 g/m$^2$, particularly 0.05 to 2.0 g/m$^2$.

In applying the foregoing aqueous solution (coating solution) to the basal paper, any known coating method, chosen properly from size press, air knife, roll, bar, gravure or other coating methods, can be adopted.

In the coating solution can optionally be contained such polymers as to be usually used as a surface sizing agent, for example, starch, polyvinyl alcohol, carboxymethyl cellulose and the like. Moreover, there can be added other surface sizing agents, pigments, dispersants, defoaming agents, dyes, fluidity modifiers and so on.

The thus prepared ink jet recording paper succeeds in adjusting the pH thereof in cold water extraction within the range of 6.0 to 8.0.

The recording paper prepared in accordance with the present invention can be used as PPC paper also, as well as in the graphic arts including offset printing.

As described above in detail, the ink jet recording paper of the present invention contains a filler of the kind which has pH 4.0–8.0 in the condition of 10 wt % dispersion and is designed so as to have pH 6.0–8.0 in the cold water extraction, so that not only printed ink letters have high optical density and satisfactory color developability on the present recording paper when an ink jet recording method is adopted in printing, but also the present recording paper has excellent preservation.

EXAMPLE

Now, the present invention will be illustrated in greater detail by reference to the following examples. However, the invention should not be construed as being limited to these examples.

EXAMPLE 1

Fine paper having a basis weight of 64.0 g/m$^2$ and consisting essentially of 94 parts by weight of LBKP (Hard Wood Bleached Kraft Pulp) (c.s.f. 400 ml), 6 parts by weight of kaolinite (the pH in the condition of 10 wt % dispersion: 4.9), 0.02 part by weight of an internal sizing agent (of alkylketene dimer type) and 0.5 part by weight of cationized starch was prepared.

Then, on the obtained fine paper was coated a coating solution containing oxidized starch in a concentration of 5 wt % and sodium hydrogen carbonate in a concentration of 7.0 wt % so as to have a coverage of 3.5 g/m$^2$ based on sodium salt in accordance with a size press coating method. The thus prepared ink jet recording paper had pH 7.8 in the cold water extraction, which fell within the scope of the present invention.

Recording was performed on the recording paper described above using the following ink jet printers A and B. The results obtained are shown in Table 1.

Printer A: Color Ink Jet Printer, I0-725 (trade name, produced by Sharp Corporation)

Printer B: Monochromatic Ink Jet Printer, IJK-12 II Custom (trade name, produced by (CHINON Co., Ltd. )

EXAMPLE 2

Fine paper having a basis weight of 64.0 g/m$^2$ and consisting essentially of 96 parts by weight of LBKP (c.s.f. 400 ml), 4 parts by weight of illite (the pH in the condition of 10 wt % dispersion: 6.7), 0.02 part by weight of an internal sizing agent (of alkenylsuccinic acid anhydride type) and 0.5 part by weight of cationized starch was prepared.

Then, on the obtained fine paper was coated a coating solution containing oxidized starch in a concentration of 5 wt % and disodium hydrogen phosphate in a concentration of 0.6 wt % so as to have a coverage of 0.4 g/m$^2$ based on sodium salt in accordance with a size press coating method. The thus prepared ink jet recording paper had pH 7.3 in the cold water extraction, which fell within the scope of the present invention.

Recording was performed using the thus prepared recording paper in the same way as in Example 1. The results obtained are also shown in Table 1.

EXAMPLE 3

An ink jet recording paper according to the present invention was obtained by coating on the fine paper made in Example 1 a coating solution containing 5 wt % of oxidized starch and 0.05 wt % of sodium hydroxide at a coverage of 0.02 g/m$^2$ based on sodium salt in accordance with a size press coating method. The thus obtained recording paper had pH 7.6 in the cold water extraction.

Recording was performed using the thus prepared recording paper in the same way as in Example 1. The results obtained are also shown in Table 1.

EXAMPLE 4

An ink jet recording paper according to the present invention was obtained by coating on the fine paper made in Example 2 a coating solution containing 5 wt % of oxidized starch and 0.1 wt % of a surface sizing agent (of acrylic type) according to a size press coating method, and further thereon a 0.2 wt % aqueous solution of potassium hydrogen phthalate at a coverage of 0.04 g/m$^2$ based on potassium salt according to a bar coating method. The thus obtained recording paper had pH 6.2 in the cold water extraction.

Recording was performed using the thus prepared recording paper in the same way as in Example 1. The results obtained are also shown in Table 1.

EXAMPLE 5

An ink jet recording paper according to the present invention obtained in the same manner as in Example 4, except that sodium silicate was used in the place of potassium hydrogen phthalate and a coverage of the sodium salt was adjusted to 0.1 g/m$^2$. The thus obtained recording paper had pH 7.7 in the cold water extraction.

Recording was performed using the thus prepared recording paper in the same way as in Example 1. The results obtained are also shown in Table 1.

EXAMPLE 6

An ink jet recording paper according to the present invention was obtained in the same manner as in Example 4, except that a 5.0 wt % aqueous solution of sodium dihydrogen phosphate was used in the place of the 0.2 wt % aqueous solution of potassium hydrogen phthalate and a coverage of the sodium salt was adjusted to 1.5 g/m$^2$. The thus obtained recording paper had pH 6.3 in the cold water extraction.

Recording was performed using the thus prepared recording paper in the same way as in Example 1. The results obtained are also shown in Table 1.

COMPARATIVE EXAMPLE 1

Fine paper having a basis weight of 64.0 g/m$^2$ and consisting essentially of 92 parts by weight of LBKP (c.s.f. 400 ml), 8 parts by weight of calcium carbonate (the pH in the condition of 10 wt % dispersion: 9.4), 0.02 part by weight of an internal sizing agent (of alkylketene dimer type) and 0.5 part by weight of cationized starch was prepared.

Then, on the obtained fine paper was coated a coating solution containing oxidized starch in a concentration of 5 wt % and sodium hydroxide in a concentration of 0.05 wt % so as to have a coverage of 0.02 g/m$^2$ based on sodium salt in accordance with a size press coating method. The thus prepared ink jet recording paper had pH 8.6 in the cold water extraction.

Recording was performed using the thus prepared recording paper in the same way as in Example 1. The results obtained are also shown in Table 1.

COMPARATIVE EXAMPLE 2

On the fine paper made in Example 1 was coated a coating solution containing 5 wt % of oxidized starch and 0.1 wt % of a surface sizing agent (of acrylic type) in accordance with size press coating method. The thus obtained recording paper had pH 6.2 in the cold water extraction.

Recording was performed using the thus prepared recording paper in the same way as in Example 1. The results obtained are also shown in Table 1.

COMPARATIVE EXAMPLE 3

On the fine paper made in Example 2 was coated a coating solution containing 5 wt % of oxidized starch and 0.4 wt % of sodium hydroxide at a coverage of 0.2 g/m$^2$ based on sodium salt in accordance with size press coating method. The thus obtained recording paper had pH 8.5 in the cold water extraction.

Recording was performed using the thus prepared recording paper in the same way as in Example 1. The results obtained are also shown in Table 1.

COMPARATIVE EXAMPLE 4

On the fine paper made in Example 1 was coated a coating solution containing 5 wt % of oxidized starch and 0.1 wt % of a surface sizing agent (of acrylic type) in accordance with a size press coating method, and further thereon was coated a 5.0 wt % aqueous solution of potassium hydrogen phthalate at a coverage of 1.0 g/m$^2$ based on potassium salt in accordance with a bar coating method. The thus obtained recording paper had pH 5.5 in the cold water extraction.

Recording was performed using the thus prepared recording paper in the same way as in Example 1. The results obtained are also shown in Table 1.

COMPARATIVE EXAMPLE 5

On the fine paper made in Comparative Example 1 was coated a coating solution containing 5 wt % of oxidized starch and 0.1 wt % of a surface sizing agent (of acrylic type) in accordance with size press coating method. The thus obtained recording paper had pH 8.3 in the cold water extraction.

Recording was performed using the thus prepared recording paper in the same way as in Example 1. The results obtained are also shown in Table 1.

COMPARATIVE EXAMPLE 6

Fine paper having a basis weight of 64.0 g/m$^2$ and consisting essentially of 92 parts by weight of LBKP (c.s.f. 400 ml), 8 parts by weight of activated clay (the pH in the condition of 10 wt % dispersion: 3.8), 0.02 part by weight of an internal sizing agent (of alkylketene dimer type) and 0.5 part by weight of cationized starch was prepared.

Then, on the obtained fine paper was coated a coating solution containing oxidized starch in a concentration of 5 wt % and sodium hydrogen carbonate in a concentration of 7.0 wt % so as to have a coverage of 3.5 g/m$^2$ based on sodium salt in accordance with a size press coating method. The thus prepared ink jet recording paper had pH 6.3 in the cold water extraction.

Recording was performed using the thus prepared recording paper in the same way as in Example 1. The results obtained are also shown in Table 1.

TABLE 1

| | Filler | (pH) Kind of Salt | Coverage of Salt (g/m$^2$) | pH in Cold Water Extraction | Dot Density (A) Black | Indigo | Red | Yellow | Block Solid Printing (B) Density | Discoloration |
|---|---|---|---|---|---|---|---|---|---|---|
| Example | | | | | | | | | | |
| 1 | kaolinite | (4.9) sodium hydrogen carbonate | 3.50 | 7.8 | 1.21 | 1.15 | 1.15 | 1.16 | 1.22 | not observed |

TABLE 1-continued

| | Filler | (pH) | Kind of Salt | Coverage of Salt ($g/m^2$) | pH in Cold Water Extraction | Dot Density (A) Black | Indigo | Red | Yellow | Block Solid Printing (B) Density | Discoloration |
|---|---|---|---|---|---|---|---|---|---|---|---|
| 2 | illite | (6.7) | disodium hydrogen phosphate | 0.40 | 7.3 | 1.23 | 1.16 | 1.15 | 1.16 | 1.25 | not observed |
| 3 | kaolinite | (4.9) | sodium hydroxide | 0.02 | 7.6 | 1.18 | 1.12 | 1.13 | 1.14 | 1.20 | not observed |
| 4 | illite | (6.7) | potassium hydrogen phthalate | 0.04 | 6.2 | 1.19 | 1.11 | 1.13 | 1.13 | 1.21 | not observed |
| 5 | illite | (6.7) | sodium silicate | 0.10 | 7.7 | 1.20 | 1.12 | 1.12 | 1.12 | 1.21 | not observed |
| 6 | illite | (6.7) | sodium dihydrogen phosphate | 1.50 | 6.3 | 1.22 | 1.13 | 1.16 | 1.14 | 1.22 | not observed |
| Comparative Example | | | | | | | | | | | |
| 1 | calcium carbonate | (9.4) | sodium hydroxide | 0.02 | 8.6 | 1.02 | 0.80 | 1.04 | 0.99 | 1.00 | not observed |
| 2 | kaolinite | (4.9) | — | — | 6.2 | 0.98 | 0.90 | 1.05 | 1.02 | 1.01 | not observed |
| 3 | illite | (6.7) | sodium hydroxide | 0.20 | 8.5 | 1.06 | 0.85 | 1.09 | 1.05 | 1.18 | not observed |
| 4 | kaolinite | (4.9) | potassium hydrogen phthalate | 1.00 | 5.5 | 1.17 | 1.09 | 1.10 | 1.08 | 1.17 | observed |
| 5 | calcium carbonate | (9.4) | — | — | 8.3 | 0.95 | 0.77 | 0.96 | 0.96 | 0.93 | not observed |
| 6 | activated clay | (3.8) | sodium hydrogen carbonate | 3.50 | 6.3 | 1.14 | 1.05 | 1.06 | 1.01 | 1.10 | observed |

NOTE:
(A) IO-725
(B) IJK-112II Custom

What is claimed is:

1. A filled and coated paper suitable for ink jet recording formed from wood cellulose, wherein the paper when ink jet color printed forms letters which have high optical density and satisfactory color developability by being filled with a kaolinite and/or illite filler having a pH value of about 4.0–8.0 as a 10 wt. % dispersion and by being coated on at least one side thereof with an alkali-metal salt at a coverage rate of about 0.01–5.0 $g/m^2$ which imparts a pH thereto of about 6.0–8.0 in cold water extraction.

2. The paper of claim 1, wherein said filler in a 10 wt % dispersion has a pH of about 7.

3. The paper of claim 1, wherein the content of said filler in the paper is from about 3 to 30 wt %.

4. The paper of claim 2, wherein the content of said filler in the paper is from 3 to 30 wt %.

5. The paper of claim 1, wherein the coverage of said alkali metal salt is from about 0.05 to 2.0 $g/m^2$.

6. The paper of claim 2, wherein the coverage of said alkali metal salt ranges from about 0.05 to 2.0 $g/m^2$.

7. The paper of claim 1, wherein said alkali metal salt is at least one salt selected from a group consisting of hydroxides of alkali metals, silicates of alkali metals, carbonates or hydrogen carbonates of alkali metals, phosphates, hydrogenphosphates or dihydrogenphosphates of alkali metals, borates of alkali metals, aluminates of alkali metals and alkali metal salts of organic compounds containing an acidic hydrogen.

8. The paper of claim 1, wherein said filler in 10 wt. % dispersion has a pH of about 7; wherein the content of said filler in the paper ranges from 3 to 30 wt. %; and wherein the coverage of said alkali metal salt ranges from about 0.05 to 2.0 $g/m^2$.

9. The paper of claim 7, wherein the pH of the paper is 6.2–7.8.

* * * * *